US007055266B2

(12) United States Patent
Elsey

(10) Patent No.: US 7,055,266 B2
(45) Date of Patent: Jun. 6, 2006

(54) ELECTROSTATICALLY DISSIPATIVE ATHLETIC SHOE

(76) Inventor: Wayne Elsey, 2133 Lake Shore Dr., Old Hickory, TN (US) 37138

( * ) Notice: Subject to any disclaimer, the term of this patent is extended or adjusted under 35 U.S.C. 154(b) by 0 days.

(21) Appl. No.: 10/117,796

(22) Filed: Apr. 1, 2002

(65) Prior Publication Data

US 2002/0112375 A1 Aug. 22, 2002

(51) Int. Cl.
*A43B 13/38* (2006.01)

(52) U.S. Cl. ..... 36/30 R; 36/44

(58) Field of Classification Search ..... 36/9 R, 36/113, 30 R, 44, 25 R
See application file for complete search history.

(56) References Cited

U.S. PATENT DOCUMENTS

| | | | | |
|---|---|---|---|---|
| 2,261,072 | A | 10/1941 | Monahan | |
| 2,279,094 | A | 4/1942 | Siers | |
| 2,879,452 | A | 3/1959 | Page | |
| 2,884,717 | A | 5/1959 | Goldberg | |
| 2,931,110 | A | 4/1960 | Pietrocola | |
| 3,007,083 | A | 10/1961 | MacQuaid, Jr. et al. | |
| 3,027,661 | A | 4/1962 | McCord | |
| 3,079,530 | A | 2/1963 | MacQuaid et al. | |
| 3,100,354 | A | 8/1963 | Lombard et al. | |
| 3,290,801 | A | 12/1966 | Bente | |
| 3,383,559 | A | 5/1968 | Oesterheld | |
| 3,406,316 | A | 10/1968 | Ito | |
| 3,898,538 | A | 8/1975 | Dalton | |
| 3,993,932 | A | 11/1976 | Weigl | |
| 4,150,418 | A | 4/1979 | Berbeco | |
| 4,366,630 | A | 1/1983 | Bloom | |
| 4,689,900 | A * | 9/1987 | Ishibashi | 36/103 |
| 4,785,371 | A | 11/1988 | Edwards | |
| 4,926,570 | A * | 5/1990 | Fohst | 36/43 |
| 5,233,769 | A * | 8/1993 | Weber | 36/44 |
| 5,319,867 | A | 6/1994 | Weber | |
| 5,426,870 | A | 6/1995 | Purnell et al. | |
| 5,448,840 | A | 9/1995 | Cheskin | |
| 5,653,047 | A | 8/1997 | Franey | |
| 6,003,247 | A * | 12/1999 | Steffe | 36/45 |

* cited by examiner

*Primary Examiner*—Mickey Yu
(74) *Attorney, Agent, or Firm*—Stites & Harbison PLLC; Richard S. Myers, Jr.

(57) ABSTRACT

An electrostatically dissipative athletic shoe. The shoe includes an outsole, a midsole, and an insole. The insole is preferably formed of a nylon fabric material. The insole is stitched with an electrically conductive thread in a zig-zag pattern, and electrically conductive glue is provided between the insole and the midsole and is disposed so as to make contact with the ESD thread. Preferably, the midsole includes at least two spaced-apart holes therethrough and an electrically continuous loop of ESD thread passes loosely through the holes and across opposite top and bottom surfaces of the midsole. Preferably, ESD glue is provided between the outsole and the midsole and is disposed so as to make contact with the loop. Preferably, the shoe includes a sockliner that is also stitched with an electrically conductive thread in a zig-zag pattern, and electrically conductive glue is provided between the sockliner and the insole and is disposed so as to make contact with the ESD thread of the sockliner and the ESD thread of the insole.

20 Claims, 1 Drawing Sheet

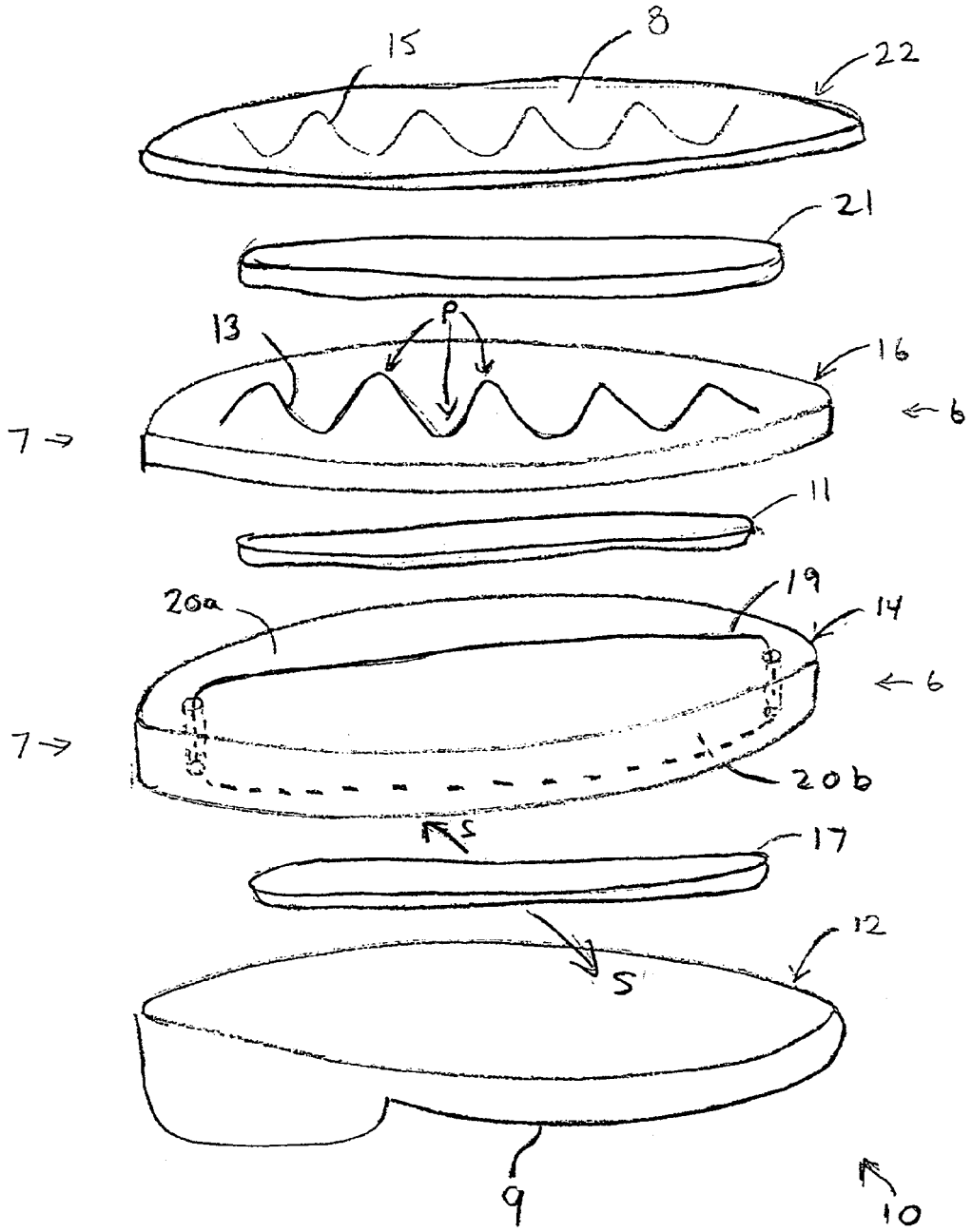
15
8
22
21
13
P
16
6
7
11
20a
19
14
6
7
20b
S
17
12
S
9
10

ELECTROSTATICALLY DISSIPATIVE ATHLETIC SHOE

FIELD OF THE INVENTION

The present invention relates to an electrostatically dissipative athletic shoe, which combines the comfort and wear characteristics of an athletic shoe with the characteristic of type 1 or 2 electrostatic dissipation (hereinafter "ESD").

BACKGROUND OF THE INVENTION

Athletic shoes are known to be more comfortable and lighter in weight than traditional footwear formed of a single "cup" sole. This is because the cup sole has had to provide, by itself, a number of different properties, including hardness or anti-wearing capability, shock absorption and spring, and optimizing these properties typically requires trade-offs.

The athletic shoe provides a two-part sole employing an outsole and a separate midsole overlying the outsole. By essentially splitting the cup sole into two parts, it is possible to tailor each part more particularly for its function and achieve increases in performance and comfort along with decreases in weight. For example, the outsole can be tailored for anti-wearing capability, while the midsole can be tailored for shock absorption, spring, and comfort. The outsole and midsole can be provided with different densities as well as other differing material characteristics.

There have been efforts to form a cupsole mimicking an outsole/midsole design by forming the cupsole in a two stage molding process. However, the material limits imposed by such processes have deprived them of achieving complete success. There remains a performance and weight advantage in the outsole/midsole design.

In parallel with the trend toward performance oriented footwear, there has been a trend in the workplace away from heavy industry and toward light industry. The latter generally requires lighter gear and apparel, including shoes, and workers to a greater extent can select for the workplace the footwear that they prefer, which is often the same footwear that they choose to wear on the street. For example, it can be seen that the old-style, typically heavy, safety shoe is required to a greater extent where workers handle heavy equipment and move heavy loads in environments that are relatively hostile. These requirements are significantly diminished in the relatively benign environments found in the more office-like factories employed for light assembly. As a particularly important example, workplace safety concerns in the electronics industry are lessened because workers are not typically exposed to the risks of operating heavy machinery and handling heavy parts. It is very common in this industry for workers to wear the same shoes during work that they wear for purposes of leisure.

Integrated electronic components have always been susceptible to damage from the electrostatic charges that normally build up on a workers'body as the worker moves about. These charges can be as high as 20,000 volts and may be conducted into the components so as to arc across individual transistors inside, permanently damaging them. This risk continues to increase as the spacing between current carrying paths on the integrated circuits become closer together, in order to increase the density of electronic components on the integrated circuit. Because of this, it is now mandatory in electronics assembly to provide for some means for draining or dissipating static charge from workers through a controlled resistance that, although quite high, has been found to be effective for this purpose.

The prior art has frequently recognized the need to provide means for controlling electrostatic discharge integrated with a worker's shoe. Edwards, U.S. Pat. No. 4,785,371 as well as others provide such means in footwear employing cup sole construction. Cheskin, U.S. Pat. No. 5,448,840 proposes to provide ESD in an athletic shoe; however, the proposal requires providing a conductive integral extension of a ground contacting outsole which extends from a peripheral edge of an outsole upwardly around the edge of other shoe sole components and is integrally attached to the inside or outside surface of the upper of the shoe such that it makes substantial contact with the foot of the wearer. As the conductive extension is formed of the same material as the outsole, this has a disadvantage of increasing the relative amount of outsole material required to form the shoe, defeating to some extent the gains achieved by splitting the cup sole into an outsole and a midsole. An additional disadvantage of the conductive integral extension is that it forms an additional structural member that impacts and alters the desired characteristics of the shoe. Cheskin recognizes, however, that the materials of which a sockliner, insole, midsole and outsole are comprised are typically different and separate, so that creating an effective electrically conductive path between the bottom of the wearer's foot and the outsole is difficult.

It may be noted that electrostatically dissipative shoes are commonly rated as to their resistive characteristics. A so-called "type 1" rating indicates a shoe with an overall resistance, from a topmost surface of the shoe sole to a bottommost surface of the shoe sole, in the range of 1–100 megohms, and a "type 2" rating indicates an overall resistance in the range 1–1000 megohms.

The assignee of the present invention has manufactured and marketed athletic shoes having ESD characteristics that have provided all of the advantages of athletic shoe structure and represented a significant advance over the then-current prior art. However, further improvements in the reliability and cost-effectiveness of the ESD characteristics remain desirable. Accordingly, there is a need for an electrostatically dissipative athletic shoe that provides for increased control of ESD characteristics as well as decreased cost of manufacture.

SUMMARY OF THE INVENTION

The invention disclosed herein is an electrostatically dissipative athletic shoe. Within the scope of the invention, there is an athletic shoe that provides for between about 2 and 10 megohms of resistance to static electricity between the ground and the wearer's sock. The shoe includes an outsole, a midsole, and an insole. The insole is preferably formed of a nylon fabric material. The insole is stitched with an electrically conductive thread ("ESD thread") in a zig-zag pattern to provide a controlled resistance through the insole. Electrically conductive glue ("ESD glue") is provided between the insole and the midsole and is disposed so as to make contact with the ESD thread of the insole to provide a controlled resistive path from the insole to the midsole.

Preferably, the midsole includes at least two spaced-apart holes therethrough and an electrically continuous loop of ESD thread passes loosely through the holes and across opposite top and bottom surfaces of the midsole to provide a controlled resistance through the midsole. Preferably, ESD glue is provided between the outsole and the midsole and is disposed so as to make contact with the loop, to further control the resistive path from the midsole to the outsole.

Preferably, the shoe includes a sockliner that is formed of, e.g., polyurethane. The sockliner is stitched with ESD thread in a zig-zag pattern to provide a controlled resistance through the sockliner. Preferably, ESD glue is provided between the sockliner and the insole and is disposed so as to make contact with the ESD thread of the sockliner and the ESD thread of the insole to provide a controlled resistive path from the sockliner to the insole.

Therefore, it is an object of the present invention to provide a novel and improved electrostatically dissipative athletic shoe.

It is a further object of the present invention to provide an electrostatically dissipative athletic shoe that provides for increased control of electrostatic dissipation.

It is still a further object of the present invention to provide an electrostatically dissipative athletic shoe that provides for decreased manufacturing cost.

The foregoing and other objects, features and advantages of the present invention will be more readily understood upon consideration of the following detailed description of the invention, taken in conjunction with the following drawings.

BRIEF DESCRIPTION OF THE DRAWINGS

The FIGURE is an exploded view of an electrostatically dissipative athletic shoe according to the present invention.

DETAILED DESCRIPTION OF A PREFERRED EMBODIMENT

Referring to the FIGURE, an electrostatically dissipative athletic shoe 10 according to the present invention is shown. The shoe is formed of a number of stacked layers, and preferably provides for a "type 1" ESD rating; more particularly, the overall resistance between the top surface 8 of an uppermost layer and the bottom surface 9 of a bottommost layer of the shoe is preferably between about 2 and about 10 megohms. In a preferred embodiment of the invention, the shoe 10 has at least three such layers.

Particularly, the shoe 10 comprises an outsole layer 12 (hereinafter "outsole"), a midsole layer 14 (hereinafter "midsole"), and an insole layer 16 (hereinafter "insole"), the terms "outsole", "midsole" and "insole" having meanings as they are ordinarily understood in the art of athletic shoe design.

The insole 16 is preferably formed of a fabric material, such as nylon, about 2.0 mm thick. The fabric construction of the insole 16, which incorporates woven or non-woven threads of the fabric material, is distinguished from the typical fibre board formed of relatively inflexible wood pulp in a binder such as latex. To provide for a controlled resistance through the insole, the insole is stitched with an electrically conductive thread 13 that is commonly known in the art as "ESD thread." This thread is typically a treated polyester and can be obtained, e.g., from Spapens Trading Int. B. V. of Waalwijk, Holland.

The assignee of the present application has previously marketed an electrostatically dissipative athletic shoe having an insole stitched with ESD thread. Particularly, the ESD thread was stitched through the insole as a "figure 8" pattern. According to the present invention, however, the pattern used for the ESD thread 13 of the insole 16 is a "zig-zag," defined herein as a pattern that follows a line defined between one end-point at the toe end 6 of the shoe to another end-point at the heel end 7, the line incorporating a sequence of turning points "P" progressing from one end-point to the other, the turning points demarcating alternating directions of the line. The line may be curvilinear, such as in a sine wave, or comprise substantially straight line segments intersecting at the turning points "P," and the pattern should have at least three of the turning points. By contrast, the "figure 8" pattern follows a line having two end-points and four turning points wherein the turning points do not form a sequence progressing from one end-point to the other.

As mentioned, the shoe 10 also includes a midsole 14. The midsole 14 is preferably formed of a foamed plastic, such as polyurethane or ethylvinyl acetate, to provide for the midsole characteristics of shock-absorption and spring. A quantity 11 of an electrically conductive glue known in the art as "ESD glue" is provided between the insole 16 and the midsole 14 and is disposed so as to make contact with the ESD thread 13 of the insole to provide a controlled resistive path from the insole to the midsole. The ESD glue typically comprises toluene, carbon powder and neoprene, and can be obtained, e.g., from King Her Chemical Ind. Co. of Taichung, Taiwan.

Further, according to the invention, the midsole is preferably provided with at least two holes 18*a*, 18*b*, one at the toe end 6 of the shoe 10 and one at the heel end 7, through which a continuous loop 19 of ESD thread passes loosely, the thread also running across opposite top and bottom surfaces 20*a*, 20*b* of the midsole 14, to provide a controlled resistance through the midsole. The ESD thread is not stitched through the midsole or otherwise provided to be tightly fitting through the holes because the thread will either tend to cut through the midsole or break as a result of the stresses created thereby.

The outsole 12 is preferably formed of a wear resistant material such as natural or synthetic rubber (hereinafter "rubber") that has been treated to be contriollably electrically conducting by having mixed therein electrically conductive, carbonaceous particles as the material is commonly made available in the art. Preferably, a quantity 17 of ESD glue is also provided between the outsole 12 and the midsole 14 and is disposed so as to make contact with the loop 19 of the midsole, to further control the resistive path from the midsole to the outsole.

Preferably, the shoe 10 also includes a sockliner 22 that is formed of, e.g., molded polyurethane for comfortably receiving the foot of a wearer of the shoe. The sockliner 22 is stitched with ESD thread 15 in the same or a similar zig-zag pattern as that described above for the insole; preferably, the zig-zag pattern of the ESD thread 15 of the sockliner is arranged so that its turns are in opposition to the turns of the zig-zag pattern of the ESD thread 13 of the midsole such as shown in the FIGURE. The ESD thread of the sockliner provides a controlled resistance of the sockliner. Further, a quantity 21 of ESD glue may also be provided between the sockliner and the insole which is disposed so as to make contact with the ESD thread of the sockliner and the ESD thread of the insole; however, the sockliner may be provided separately from the shoe 10 with electrostatically dissipative contact with the underlying insole being provided by the ESD thread alone.

The zig-zag patterns for the ESD thread 13, 15 of the insole and sockliner, whether arranged in opposition or not, ensure multiple points of contact therebetween, which increases the reliability and consistency of static dissipation as compared to the prior art. Moreover, the patterns more completely span and cover the surface area of the layer in which they are incorporated so that it is less likely that the natural curvatures of the wearer's foot, and the nonhomogeneous pressure distribution over all of the layers that results, will work against finding a pathway for static dissipation. The use of a fabric material for the insole, as opposed to the less flexible and harder fibre board construction, permits stitching the ESD thread 13 through the insole and ensures that the thread will not "pull-out" of the insole.

In addition to the quantities 11, 17, and 19 of ESD glue, quantities of other adhesives are preferably employed and provided adjacent the quantities of ESD glue, such as on each of sides "S" thereof, to increase the security of attachment of the layers to one another.

The resistivities of the ESD thread and the ESD glue may be tailored to provide, in consideration of the number of layers of the shoe 10 and the materials of which the layers are constructed, the desired overall resistance of the shoe.

It is to be recognized that, while a particular electrostatically dissipative athletic shoe has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. An electrostatically dissipative athletic shoe that provides between about 2 and 10 megohms of resistance to static electricity, comprising:

a midsole; and an insole having a thickness and a top and bottom surface and, stitched patternwise through the thickness, a length of a thread, the thread having an electrical resistivity that is less than the resistivity of the insole, wherein the patternwise stitching through the thickness of the insole disposes a portion of the thread on the top surface of the insole and a portion of the thread on the bottom surface of said insole, the stitching forming a zig-zag pattern.

2. The athletic shoe of claim 1, the insole being adhered to the midsole with a glue that has an electrical resistivity that is less than the resistivity of the insole; wherein when adhering the midsole to the insole, the glue contacts a length of said thread stitched through the thickness of the insole.

3. The athletic shoe of claim 1, wherein the midsole consists essentially of polyurethane.

4. The athletic shoe of claim 1, wherein the midsole consists essentially of ethylvinyl acetate.

5. The athletic shoe of claim 1, further comprising an outsole that has an electrical resistivity that is substantially less than the resistivity of the midsole.

6. The athletic shoe of claim 5, wherein the outsole consists essentially of rubber.

7. The athletic shoe of claim 5, wherein the midsole consists essentially of one of polyurethane and ethylvinyl acetate.

8. The athletic shoe of claim 5, wherein said midsole includes a continuous loop of a thread having an electrical resistivity that is less than the resistivity of the insole extending through at least two apertures through the thickness of the midsole, the loop running along said top and bottom surfaces.

9. The athletic shoe of claim 8, wherein the midsole and insole are adhered by glue that has an electrical resistivity less than the resistivity of the outsole; wherein when adhering the midsole to the insole, the gule contacts a length of the loop of thread.

10. The athletic shoe of claim 9, wherein the glue disposed between said insole and said midsole contacts a length of the thread stitched through a thickness of the insole.

11. The athletic shoe of claim 10, wherein the midsole is one of polyurethane and ethylvinyl acetate.

12. The athletic shoe of claim 11, wherein the outsole consists essentially of rubber.

13. The athletic shoe of claim 1, further comprising a sockliner that has a thickness and, stitched patternwise through the thickness, a length of thread that has an electrical resistivity less than the resistivity of the sockliner, wherein the patternwise stitching through the thickness of the sockliner disposes a portion of the thread on the top surface of the sockliner and a portion of the thread on the bottom surface of said sockliner, the stitching forming a zig-zag pattern.

14. The athletic shoe of claim 13, wherein the insole and sockliner are adhered with glue that contacts a length of the thread stitched into the sockliner, the glue having an electrical resistivity less than the resistivity of the sockliner.

15. The athletic shoe of claim 14, wherein said glue contacts a length of thread stitched into the insole.

16. The athletic shoe of claim 15, further comprising an outsole that has an electrical resistivity that is substantially less than the resistivity of said thread stitched into the insole.

17. The athletic shoe of claim 16, wherein said midsole includes a continuous loop of a thread having an electrical resistivity that is less than the resistivity of the insole extending through at least two apertures through the thickness of the midsole, the loop running along said top and bottom surfaces.

18. The athletic shoe of claim 1, wherein the midsole is a plastic material.

19. The athletic shoe of claim 1, wherein the insole is a fabric material.

20. The athletic shoe of claim 1, wherein the thread, having been stitched in a zig-zag pattern, follows a line generally defined between one end-point at the toe end of the shoe to another end point at the heel end, the line incorporating a sequence of turning points progressing from one end point to the other, the turning points demarcating alternating directions of the line.

* * * * *